United States Patent [19]

Belttary

[11] 4,405,846

[45] Sep. 20, 1983

[54] ARC CHAMBER CHANNEL

[75] Inventor: Harold E. Belttary, Rio Piedras, P.R.

[73] Assignee: GTE Products Corporation, Stamford, Conn.

[21] Appl. No.: 260,857

[22] Filed: May 6, 1981

[51] Int. Cl.[3] ..... H01H 33/08; H01H 33/10

[52] U.S. Cl. ..... 200/144 R; 200/147 R

[58] Field of Search ..... 200/144 R, 147 R

[56] References Cited

U.S. PATENT DOCUMENTS 2,898,427 8/1959 Nadeau ..... 200/147 R 3,283,102 11/1966 Gelzheiser ..... 200/144 R

*Primary Examiner*—Robert S. Macon

*Attorney, Agent, or Firm*—Fred Fisher

[57] ABSTRACT

An arc chamber channel for providing cooling of an electric arc and quenching thereof for use with a circuit breaker includes an integral, generally U-shaped member which forms a base and opposing side walls. One end of the opposing side walls has extending tabs which are folded outwardly, providing a pair of point contacts for engaging side walls of a circuit breaker housing. An opposite end of the base is formed with an extending tab for engaging a molded feature of a side wall of the circuit breaker housing. Thus, all the extending tabs are adapted to space the channel away from the side walls of the circuit breaker, thereby exposing outer surfaces of the channel when in use in a circuit breaker. The base has an arrangement of venting holes therein. The tabs can be diagonally folded outwardly, and the channel can be formed of steel. An improved circuit breaker housing can include the channel, the housing further including a vent passage within the housing which is exterior to the channel. Molded projections in the housing are formed in a vent passage in proximity to the holes to provide cooling surfaces. The projections are spaced away from the holes sufficiently to provide passage of expulsive gases.

4 Claims, 3 Drawing Figures

ARC CHAMBER CHANNEL

BACKGROUND OF THE INVENTION

1. Field of the Invention

This invention relates to circuit breakers of the type described in U.S. Pat. No. 3,114,023, issued Dec. 10, 1963 to R. E. Locher. In particular, this invention relates to an electric arc cooling and quenching means for use in such breakers, such as a channel for providing electric arc cooling and quenching therefor. Accordingly, it is a general object of this invention to provide new and improved cooling and quenching means of such character.

2. Description of the Prior Art

Circuit breakers of the type described in the foregoing patent are often referred to as minimum modulus because the pole width is a minimum for circuit breakers of the same and higher electrical ratings and which have the same or similar profile configuration. The minimum modulus circuit breaker is typically designed to be used in the same panel board as circuit breakers of twice the width, similar profile and same ratings. The circuit breaker described by Locher is distinct in that the ratio of its width to its height and breadth is low relative to circuit breakers of the same electrical ratings.

3. Statement in Accordance with 37 CFR 1.56

In accordance with the provisions of 37 CFR 1.56, the following patented art may be of interest.

| U.S. Pat. No. | Patentee |
|---|---|
| 2,244,061 | Graves |
| 2,953,666 | Matthias |
| 3,155,801 | Pokorny |
| 3,177,324 | Boehne |
| 3,728,506 | Heehler et al |
| 3,898,407 | Hodgson |

Graves, U.S. Pat. No. 2,244,061, discloses an arc quenching unit having a U-shaped appearance, with vent holes in its top plate. The principles of its construction are not specifically pertinent to the instant invention in that the Graves device is bulky and constructed of numerous parts in contradistinction to the subject matter of the applicant.

Matthias, U.S. Pat. No. 2,953,666, discloses arc extinguishing chutes with slotted top portions, which chutes are bulky and created of numerous parts.

U.S. Pat. No. 3,155,801 to Pokorny also discloses an arc chute with top openings, also of plural parts.

U.S. Pat. No. 3,177,324 to Boehne discloses perforated arc runners with one embodiment having a molded bead, also of plural parts.

U.S. Pat. No. 3,728,506 to Heehler et al discloses a removably mounted arc chute which can be locked into a mechanism to hold the contacts of the circuit breaker in an open or closed position.

U.S. Pat. No. 3,898,407 to Hodgson is of interest for a part 110 which is U-shaped, in general configuration, with perforation and extending tabs. The part 110 of Hodgson is a support member and not an arc channel.

SUMMARY OF THE INVENTION

The narrowness of minimum modulus circuit breakers, as referred to hereinabove, dictates a thin walled housing which frequently demands the use of expensive, high strength plastic compounds, particularly when high, short circuit, interruption capacity is to be achieved. The use of expensive, high strength plastics substantially reduces economy that is sought in a minimum modulus circuit breaker.

As described hereinabove, U-shaped steel channels, which may be plated, for use in arc chambers of low voltage circuit breakers are commonly used to improve short circuit interruption capacity. Such channels vary in size and shape; they can be slotted, embossed and formed in various configurations suitable for various applications. The effectiveness of an arc chamber channel can be judged by the economy it provides and/or the performance gained through its use.

Another object of this invention is to achieve high short circuit interruption capacity in minimum modulus circuit breakers.

Still another object of this invention is to achieve high short circuit interruption capacity by use of an arc quenching and cooling arc chamber channel of the type described herein.

Yet another object of this invention is to provide a new and improved arc cooling and quenching channel for use in a circuit breaker housing constructed of primarily urea formaldehyde molding compound.

In accordance with one embodiment of the invention, a channel for providing electric arc cooling and quenching for use in a circuit breaker includes an integral, generally U-shaped member which forms a base and opposing side walls from one end to an opposite end. One end of the opposing side walls has entending tabs which are folded outwardly, thereby providing a pair of point contacts for engaging side walls of a circuit breaker housing. The opposite end of the base is formed with an extending tab for engaging a molded feature of a side wall of the circuit breaker housing. Thus, all the extending tabs are adapted to space the channel away from the side walls of the circuit breaker, thereby exposing the outer surfaces of the channel when in use in a circuit breaker. The base is further formed with an arrangement of venting holes therein. In accordance with certain features of the invention, the tabs at the one end are folded outwardly in a diagonal manner. The channel can be formed of steel.

In accordance with another embodiment of the invention, a circuit breaker housing includes the channel as described hereinabove and further includes a vent passage within the breaker housing which is exterior to the channel. Molded projections in the housing are formed, located in the vent passage, and in proximity to the holes to provide cooling surfaces, but spaced away from the holes sufficiently to provide passage of expulsive gases.

BRIEF DESCRIPTION OF THE DRAWINGS

Other objects, advantages and features of this invention, together with its construction and mode of operation, will become more apparent from the following description, when read in conjunction with the accompanying drawings, in which.

Description of Preferred Embodiment(s)

Figure 1:
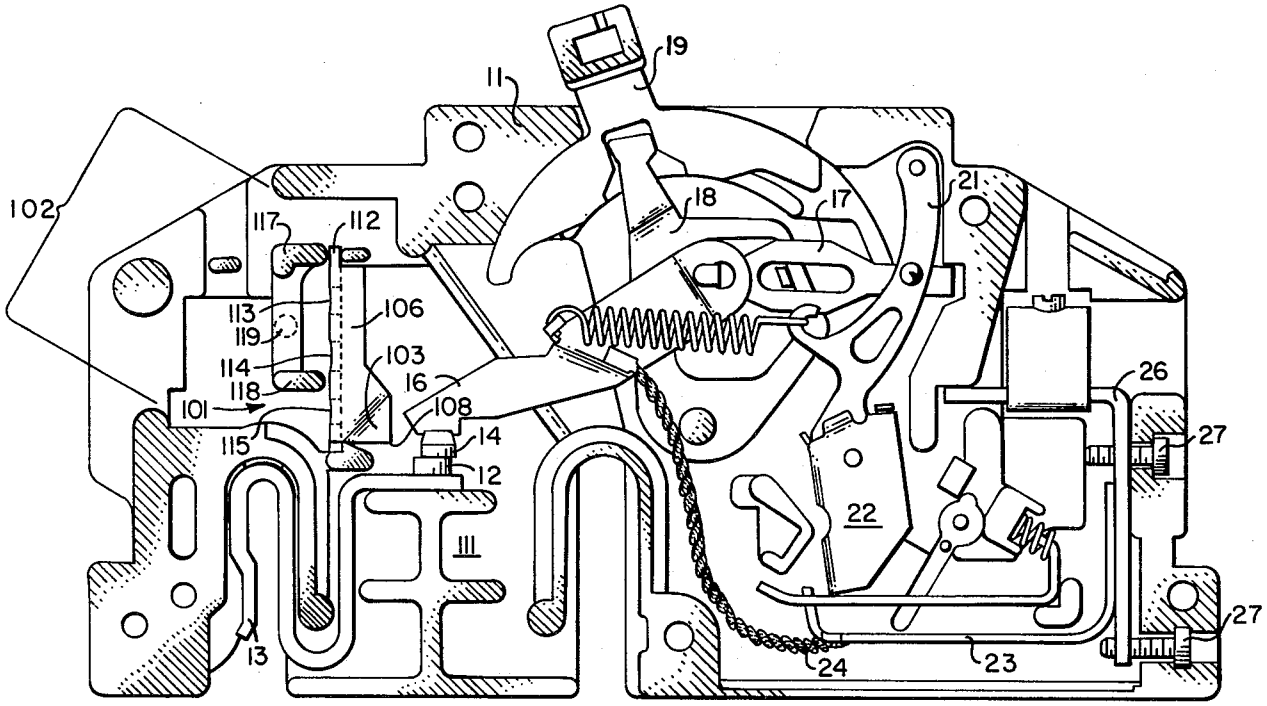
FIG. 1 is a view of a circuit breaker, with the cover removed, depicting the internal workings of such circuit breaker together with one embodiment of a channel in accordance with this invention.
Figure 4:
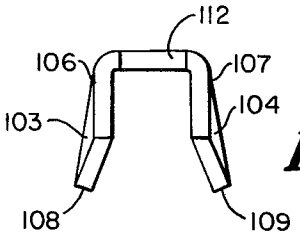
FIG. 4 is an end view of the channel depicted in FIGS. 1 through 3 inclusive.
Figure 3:
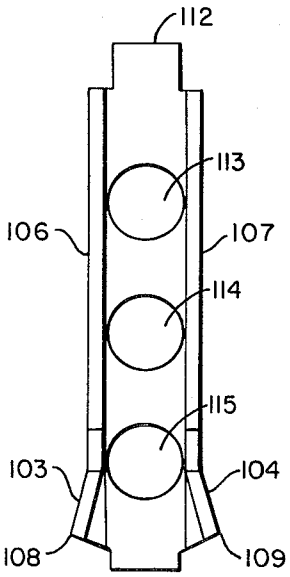
FIG. 3 is a front view of the channel as depicted in FIGS. 1 and 2, looking toward the base of the member.
Figure 2:
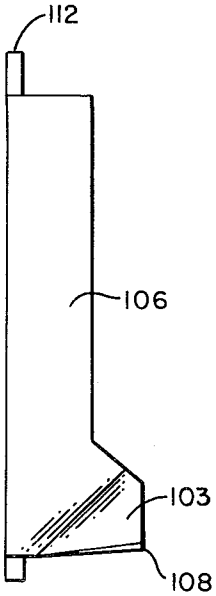
FIG. 2 is a side view of the channel depicted in FIG. 1.

Referring to FIG. 1, there is depicted a circuit breaker switch mechanism mounted in a case including a body 11 (with the cover plate removed) of a type such as shown and described in U.S. Pat. No. 3,114,023 to Locher. Typically, such a circuit breaker mechanism includes a fixed contact 12 which is coupled to a bus clip 13. The switch mechanism includes a moving contact 14 carried on a contact arm 16, a pivot arm 17, a switch applicator 18, a finger member 19, a trigger arm 21, a latch lever 22, and a thermal trip member 23. A flexible conductor 24 is connected between the contact arm 16 and the thermal trip member 23, the trip member being spot welded to a conductor 26 fixed in the body by screws 27—27.

The operation of the trigger arm 21, the latch lever 22, and the thermal trip member 23 is the same as set forth in the Locher patent. When current through the switch exceeds a predetermined value for a predetermined time, the thermal member 23, which is ordinarily a bimetal strip, bends in a counterclockwise direction, freeing the latch lever 22 for counterclockwise rotation, which in turn frees the trigger arm 21, thereby moving the switch to the tripped or open circuit position. As the contacts 12 and 14 separate (i.e., "open"), an arc tends to occur.

The incorporation of a channel into a circuit breaker, in accordance with the invention, provides electric arc cooling and quenching, as will become more apparent hereinafter.

The arc cooling and quenching means generally includes an integral, U-shaped steel channel 101 placed in close proximity to the contacts 12, 14, along a line approximately tangential to a path through which the moving contact 14 and the end of the moving contact carrier 16 move during short circuit openings. As will be more apparent from a view of FIG. 1, the channel 101 occupies an area between the moving contact path and an arc chamber vent 102. Referring to all figures of the drawing, an increase in the depth of the channel 101 forms two tabs 103, 104, which tabs are folded diagonally outwardly from channel walls 106, 107, respectively, thereby providing two point contacts 108, 109 which touch the sides of arc chamber walls 111 of the molded housing 11. The points 108, 109, and a tab 112, at the opposite end of the U-shaped channel 101, engage molded plastic features of the circuit breaker (the molded raised feature of the circuit breaker on which the tab 112 rests is not depicted for simplicity of illustration). The points 108, 109 and the tab 112 space the channel 101 away from the molded arc chamber walls 111 of the circuit breaker. The space thereby created exposes the outer surfaces of the walls of the channel 101 and adjacent wall areas of the arc chamber.

It is noted that, in prior circuit breaker devices, arc chutes, chambers, and similar devices partially or completely shield the side walls of a circuit breaker by their close proximity. In accordance with the invention as described hereinabove, the exposed surfaces of the channel and the side walls, and the space between the channel and the side walls, serve as cooling surfaces and vent passages, respectively, for hot gases, vapors and particles produced by an arc drawn between the contacts 12, 14 upon their opening in response to a high fault current.

Further, there is an arrangement of holes 113, 114, 115 in the channel 101 which provide additional passages for expulsion of hot gases, vapors and particles from the channel 101 through the venting area 102.

Molded projections 117, 118 in the circuit breaker case 11, together with an opposing molded projection 119 (shown in dotted outline in FIG. 1) from the cover (not shown), cooperate with the holes 113, 114, 115 of the channel 101. The molded projections 117, 118, 119 in the walls of the housing and the cover protrude into the vent area 102. The molded projections are located in the vent passage and near the holes 113, 114, 115 to provide additional cooling surfaces. The projections 117, 118, 119 do not obstruct the holes 113, 114, 115. The projections, being in proximity to the holes, provide cooling surfaces. The projections and the holes are so oriented to sufficiently provide passage for expulsive gases. The tabs 108, 109 as set forth hereinabove, are diagonally folded outward. The channel 101, ideally, should be constructed of material which is, desirably, heat conductive, while maintaining a relatively low conductivity or high resistance. For cost purposes, a suitable material is steel.

The quantity, size and location of the holes and molding projections for a preferred embodiment, as shown in FIG. 1, is illustrative in nature. It will be apparent to those who are ordinarily skilled in the art that various modifications can be performed without departing from the spirit of the scope of this invention.

What is claimed is:

1. A channel for providing electric arc cooling and quenching, for use in a circuit breaker, comprising an integral, generally U-shaped member forming a base and opposing side walls from one end to an opposite end, said one end of said opposing side walls having extending tabs which are folded outwardly, thereby providing a pair of point contacts for engaging side walls of a circuit breaker housing, said opposite end of said base being formed with an extending tab for engaging a molded feature of a side wall of said circuit breaker housing, whereby all said extending tabs are adapted to space said channel away from said side walls of said circuit breaker, thereby exposing outer surfaces of said channel when in use in a circuit breaker, and said base having an arrangement of venting holes therein.

2. The channel as recited in claim 1 wherein said tabs at said one end are diagonally folded outwardly.

3. The channel as recited in claim 2 wherein said channel is steel.

4. In a circuit breaker housing including the channel as recited in claim 1, and including a vent passage within said breaker housing exterior to said channel, the improvement comprising molded projections in said housing, located in said vent passage, and in proximity to said holes to provide cooling surfaces, but spaced away from said holes sufficiently to provide passage of expulsive gases.

* * * * *